US006673994B2

(12) United States Patent
Broome et al.

(10) Patent No.: US 6,673,994 B2
(45) Date of Patent: Jan. 6, 2004

(54) INJECTION MOLDED SYNTHETIC DRUMSTICKS WITH MICROCELLULAR STRUCTURE

(76) Inventors: Russell C. Broome, 7028 Kristi Dr., Garner, NC (US) 27529; William E. Mann, 242 E. Independence Blvd., Charlotte, NC (US) 28204

( * ) Notice: Subject to any disclaimer, the term of this patent is extended or adjusted under 35 U.S.C. 154(b) by 0 days.

(21) Appl. No.: 09/821,369

(22) Filed: Mar. 29, 2001

(65) Prior Publication Data

US 2001/0035085 A1 Nov. 1, 2001

Related U.S. Application Data

(60) Provisional application No. 60/193,022, filed on Mar. 29, 2000.

(51) Int. Cl.[7] ..... G10D 13/02
(52) U.S. Cl. ..... 84/422.4
(58) Field of Search ..... 84/422.4

(56) References Cited

U.S. PATENT DOCUMENTS 4,385,544 A * 5/1983 Heiskell ..... 84/422 S
5,008,348 A * 4/1991 Takeda et al. ..... 525/474
5,260,506 A * 11/1993 Cappella ..... 84/422.4
5,341,716 A * 8/1994 Donohoe ..... 84/422.2
5,602,355 A * 2/1997 Lipp ..... 84/422.4

* cited by examiner

*Primary Examiner*—Kimberly Lockett
(74) *Attorney, Agent, or Firm*—Jeffrey K. Seto

(57) ABSTRACT

Synthetic drumsticks for musical purposes and methods for making them. The present drumsticks are characterized by having a microcellular foamed structure. The preferred method comprises injection molding of thermoplastic materials that are saturated with gasses, particularly in their supercritical phase. The products of the injection molding process are drumsticks formed to final dimensions and ready for use. The foamed materials are preferably made from filled resins. The formation of micron-scale gas cells during the molding process yields formed drumsticks that are similar to woods or better, in feel and durability. The products of the invention further have advantages of durability, recycleability, exact matching of properties (reproducibility of manufacture), improved shock absorption, and "livelier" rebound from the drumhead thus preventing forearm fatigue in the user. The present drumsticks also provide a better/sharper "ring", than wooden drumsticks, when used on cymbals. By adding coloring agents during manufacture the drumsticks can be made in any color and can also be made to glow in the dark.

7 Claims, 2 Drawing Sheets

INJECTION MOLDED SYNTHETIC DRUMSTICKS WITH MICROCELLULAR STRUCTURE

This application was first filed as provisional application and priority is claimed to Provisional Application No. 60/193,022, filed Mar. 29, 2000.

BACKGROUND OF THE INVENTION

The present invention relates generally to a method for making drumsticks and more specifically to a method for controlling the density of drumsticks during the manufacturing process.

Drumsticks have traditionally been made of wood. Although wood is familiar to everyone, it has some disadvantages. A particular disadvantage is its fragility—it is possible for a drummer to break his drumsticks during a performance. Wood is also not completely reproducible. Several attempts have been made to replace wood with plastic. These have typically involved conventional casting or extrusion, with final machining to shape—not too dissimilar to how wood is handled. However, the resulting plastic products are heavy (compared to wood), are prone to warp, usually differ in timber, texture or other variables, and are relatively expensive. Another technology that involves internally foaming plastics has potential for use in making plastic drumsticks. Traditional foaming technologies produce the familiar polystyrene and polyurethane foams, which are good insulators but have little strength. Newer foaming technology can produce much smaller bubbles, and the materials can retain much or all of the impact strength of the underlying plastic while being lighter (less dense). Such techniques are described in, for example, WO 90/07546; WO 98/08667; or WO 98/31521.

In the present system, selected plastics and fillers are melted in an extruder and a pressurized gas such as nitrogen or carbon dioxide is incorporated into the molten polymer. Extruders are well known in the art and basically comprise a barrel or tube that applies electrical heat to the polymer and a screw or auger that turns at a given rate to feed the material into the mold. The screw also applies frictional heat to the polymer.

A gate, or shut-off nozzle, is provided at one end of the barrel for release of the contained substance and a screw or plunger is provided at the opposite end for forcing the contained substance out of the shut-off nozzle. The shut-off nozzle of the extruder empties into a cavity in the mold that has a cooling system and that is in the shape of a drumstick. The mold is further provided with vents that allow the air, already in the mold, to escape upon injection of the gas-polymer mixture. When a specified amount of the gas-polymer mixture is injected into the mold, internal foaming and cooling of the mixture occurs. The amount of internal foaming that takes place is related to the amount of polymer that is injected into the cavity of the mold. By controlling the injection speed and the mold temperature, the final density and bubble size is controlled. In the present system, a very high density of nucleation sites can be achieved. After cooling is complete a drumstick can be removed from the mold and is ready for use.

SUMMARY OF THE INVENTION

An improved drumstick made from plastic, wherein the plastic is internally foamed sufficiently to give the plastic drumstick a density and resilience similar to wood and having greater impact strength than wood. The improved drumstick is made by an injection molding process that imparts a micro-foamed structure to the drumstick. The resulting drumstick provides a livelier rebound off a drum head than wooden drumsticks and a higher quality ringing sound when playing a cymbal, than previous plastic and wooden drumsticks. Further, the present drumstick lasts approximately five times as long as wooden drumsticks and can be made in various colors and even be made to glow in the dark.

BRIEF DESCRIPTION OF THE DRAWINGS

The invention of the present application will now be described in more detail with reference to the accompanying drawings, given only by way of example, in which.

DETAILED DESCRIPTION OF THE INVENTION

Figure 1:
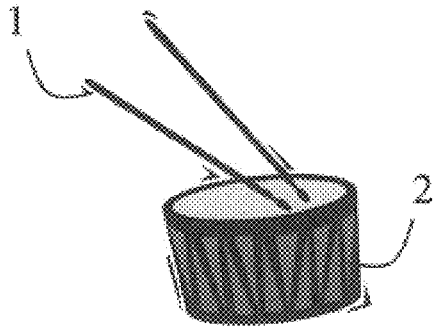
FIG. 1 shows an exemplary embodiment.
Figure 2:
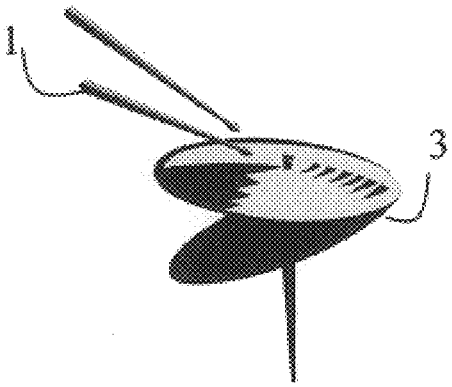
FIG. 2 shows an alternative embodiment.

For the purposes of this invention, the term "drumstick and drumsticks" applies to a means for eliciting sound from a percussion instrument. Referring to FIGS. 1 and 2, drumsticks 1 are the familiar elongated cylindrical objects, but can include other shapes, useful in musical percussion. Drumsticks 1 are commonly used to play percussion instruments such as drum 2 and cymbal 3.

The term "microbubble" means a small bubble, generally below 100 microns in diameter, and preferably is in the range of about 5 to about 50 microns. The term "microcell" means a cell, either open or closed, which is formed by the solidification of a material around a microbubble. The term "microfoamed" means a plastic containing a significant volume percent of microcells. The volume percent can range from about 5% to over 70%, and is more typically in the range of about 10% to about 60%. A preferred range, for emulation of the properties of wood, is about 20% to about 45%, although this will vary with the density of the plastic and according to the presence or absence of fillers or stiffening elements.

Drumsticks 1 and similar percussion tools are made in an improved way. The method comprises injection molding in the presence of nitrogen, carbon dioxide or other inert gases pressurized to their supercritical state. When a thermoplastic or other resin is injection molded while containing a pressurized gas, tiny bubbles of gas form in the plastic as pressure is released. The size range of these bubbles can be controlled by details of processing, including processing temperature and pressure, weight or volume percent of gas in the resin when injected into the mold, and the amount of polymer injected in the mold. When the plastic becomes solid, the bubbles become permanently included in the plastic as microcells.

In the preferred embodiments, the microcells are very small, below 100 microns. A preferred range is about 5 to about 50 microns. These small cells are particularly useful because they form a foam that is both highly rigid and of controlled density. In this regard, the microfoamed materials preferably used in this invention have many of the desirable properties of wood, when compared to typical plastics. However, in an improvement over wood, the microcells will be uniform in number per unit volume (number density), and relatively uniform in size, throughout the volume, with the exception of a skin layer on the outside of the drumstick which lacks microcells and is smooth.

In a particular embodiment, drumsticks of the invention can be made as follows. Plastic pellets and selected filler(s) are melted in an extruder and the extruder is connected to a pressurized gas tank containing a gas such as nitrogen or carbon dioxide. The gas is pressurized to a supercritical state where the gas almost enters a liquid state. The pressure required to reach this state depends upon the gas that is used. A specified amount of gas is introduced into the extruder through an injection port and the gas and polymer combine to form a homogenous fluid. The nozzle tip of the extruder is held against the sprue bushing of the mold. The mold is in the desired drumstick shape and includes cooling hardware that controls the temperature (cooling) of the mold after the gas-polymer mixture has been injected into the mold. The extruder gate is opened and a selected amount of the gas-polymer mixture is injected into the mold. Once the mixture is out of the extruder and in the mold, internal foaming of the polymer occurs. Once the mold cooling has completed, the mold is opened and the drumstick is removed and ready for use, without any further finishing.

There are several options available in the practice of the invention. Without limitation, these include the choice of resin, fillers and additives; the choice of the pressurized gas; the speed of filling the mold, the melt temperature, the mold temperature, the amount of polymer injected into the mold and, their variations during the process.

Materials:

Most thermoplastic polymers can be used in the invention, when suitable process parameters are applied. These include without limitation polyolefins, polyesters, polycarbonates, polyamides and blends and copolymers comprising subunits of these polymers.

Additives:

Any of the conventional additives used in formulation of plastics can potentially be used in the invention. These include without limitation fillers, such as silica, carbon, plasticizers, antioxidants, lubricants, fiberglass and other stiffening materials; and coloring agents such as dyes and pigments. Fillers are a particularly preferred inclusion, and are believed to increase durability and stiffness.

Gasses:

Inert gasses such as nitrogen or carbon dioxide are suitable. Suitable gasses must be pressurized to their super critical state prior to injecting into the polymer melt.

Process Type:

Any process which produces a significant population of small bubbles in the plastic is potentially suitable. The key characteristic is that the bubbles are small enough to at least maintain the mechanical properties of the finished product, such as stiffness and impact strength. Typically sizes of the bubbles will be less than 100 microns, more preferably between 5 and 50 microns. Suitable bubbles will also have a high density of nucleation within the plastic, such as greater than one billion per cc, or preferably greater than one to 100 trillion bubbles per cc.

Density of the final product can be varied from near the density of the resin being used to a density below that of wood. To the extent that mechanical properties are not compromised, densities near or somewhat below that of wood are preferred, because they will feel more natural to users and will diminish fatigue. Such densities will be in the range of about 0.5 to 1.2 grams per cubic centimeter (g/cc).

For high volume production, continuous or semicontinuous procedures are preferred. Typically, pellets of resin are fed into an extruder, and a pressurized or supercritical gas is also fed into the mixing region of the extruder. Any of a wide variety of temperatures and pressures may be used in the process, depending on the polymer, on the presence of fillers or other additives. Examples of suitable melt temperatures include about 400 to about 700 deg. F, and will depend on the types of plastic and fillers used. Examples of suitable injection speeds include 5 to 12 inches/second, and preferably faster injection speeds are used.

For an extrusion process, a small outlet orifice and a short, narrow tube leading to a final shaping die are provided. The gas nucleates while passing through the narrow tube, and foams once released from the die. The foamed extruded material would then be machined to a net final shape.

Figure 3:
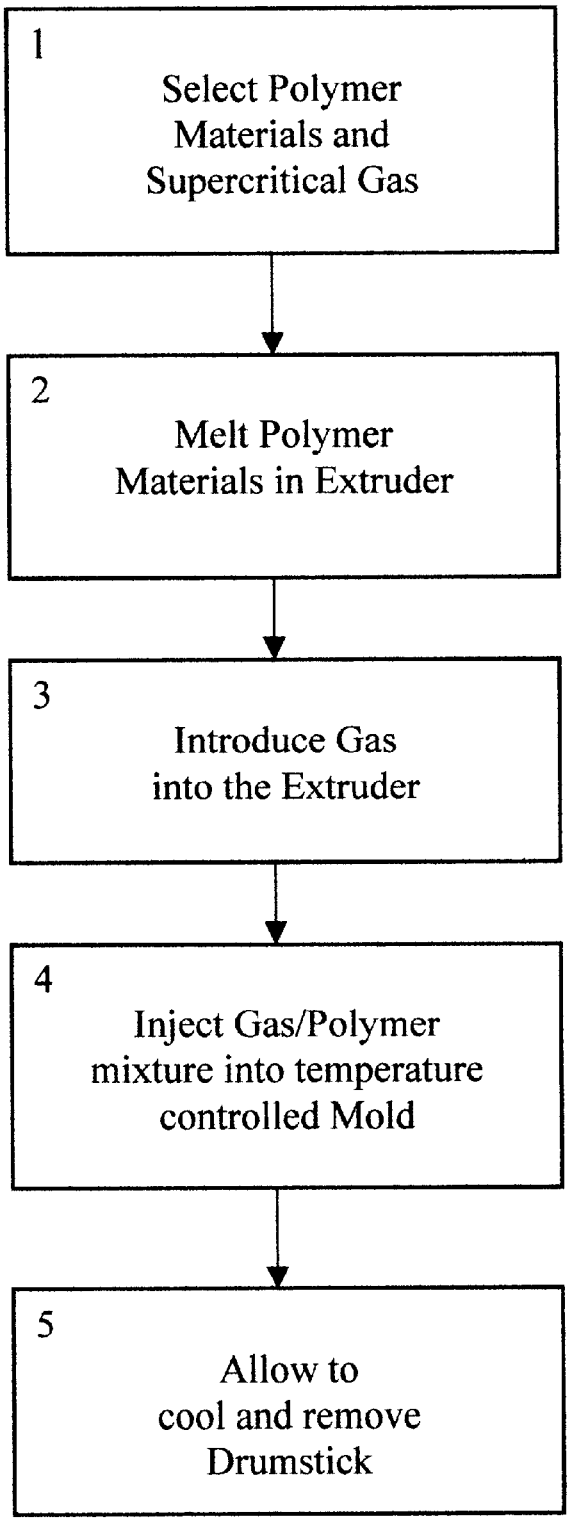
FIG. 3 is a flow chart of a method for producing an embodiment

In FIG. 3, the general steps of the preferred injection molding process are shown. In step 1, the polymer materials and gas are selected. The polymer materials include at least the plastic and at least one filler. Different fillers can be added so as to make the resulting drumstick different colors and even to make the drumsticks glow in the dark. Other fillers such as glass fibers can also be selected to enhance the performance of the drumstick. In step 2, the polymer materials are melted in the extruder. The melt temperature in the extruder is controlled and depends upon the material being melted. In step 3, the gas is introduced into the polymer mixture by injecting the gas into the extruder. The gas is pressurized to a supercritical state prior to introduction into the extruder so that it is close to a liquid state. The preferred gas is either nitrogen or carbon dioxide, but can be any inert gas. While in the extruder, the gas and polymer combine to form a gas-polymer mixture. In step 4, the gas-polymer mixture is injected into the cavity of a mold that is temperature controlled. The amount of mixture injected into the mold and the speed with which it is injected is selected so as control the amount of internal foaming. The most important parameter in the present process is the amount of mixture that is injected into the mold. After the gas-polymer mixture is injected into the mold, internal foaming of the mixture starts immediately thereby enlarging the size of the injected gas-polymer mixture until it fills the mold. If a large amount of mixture is injected into the mold, then only a small amount of foaming will take place before the cavity inside the mold is completely filled. This will lead to very small microcells being formed and a heavy product. If a small amount of mixture is injected into the mold, then a large amount of foaming will occur before the mixture completely fills the cavity inside the mold. This will lead to larger microcells being formed and a lighter end product. Other parameters that are also used to control the properties of the final product are injection speed and mold temperature. Generally, the injection speed from the extruder to the mold should be as fast as possible, at least 5 in/s. Preferably the injection speed is 12 in/s.

The mold is provided with cooling channels to control the cooling rate of the molten mixture. The cool mold also prevents microbubbles from forming on the outer skin of the drumstick. Thus when the drumstick is removed from the mold, it has a smooth outer surface. In step 5 of FIG. 3, the drumstick is allowed to cool in the mold. Then the mold is opened and the drumstick is removed. The drumstick needs no further finishing and is ready for use. For more drumsticks of the same type, the process is repeated starting at step 4, since typically the gas-polymer mixture is prepared and combined in steps 2 & 3 simultaneously during steps 4 & 5. It is well known in injection molding to have an extruder for plastic mixtures which are ready to inject.

The following experiments were performed. We started with an unfilled polymethylpentene or TPX material and then tested a 30% glass filled syndiotactic polystyrene or SPS material. It required no pre-drying. The gas of choice for both materials was nitrogen. We used an Engel 200 ton tiebar-less injection molding machine fitted with gas injection ports with MuCell controllers and software. The TPX material was processed at slightly lower temperatures (530–570 degrees F) than without gas when using a gas/polymer solution in the barrel. We ran a cold mold (55 degrees F). It was difficult to get a homogeneous mixture because of the very small shot size required. Shot size is the amount of plastic ejected from the extruder (barrel and screw) to make a molded part. It is usually measured in inches of stroke, which a measure of volume extruded. The machine has a capacity of about 5 inches and we were using about a half an inch. Once we adjusted the conditions and made a few good parts from the TPX unfilled polymer, we found that the TPX sticks were too flexible. We next tested the stiffer SPS material at the same mold temperatures. We achieved parts that really looked and felt good, although they were still a little on the heavy side (too dense). The SPS sticks we made were tested by two drummers, who agreed that the glass-filled SPS sticks have the same sound as wood, but with a more lively action off the drum head. They seem to absorb the impact well. The next question was how to make the sticks lighter without sacrificing the sound quality.

Next, we tried several process variations:

taking the mold temperature up to 75 degrees F;

increasing the amount of nitrogen injected, including amounts above the saturation point (of nitrogen in the polymer) at that temperature. None of the variants we tried decreased the weight (density) of the foamed drumsticks.

We did not, in this round of experiments, vary the optimum operating temperatures (520–560 degrees F) in the extruder barrel, but this is another parameter to be tested. Also, we were injecting as quickly as possible; we noted that as a result we did not need any hold or pack time.

Based on the results to date, it appears that having a filled material, such as glass, may be important for obtaining the right sound properties. In order to get the weight down even further we will look at several variables in future experiments. These include using a polymer with a lower specific gravity. For example, we will try a glass filled TPX, and also a different glass filled SPS formulation that has an impact modifier (rubber) in it, which has a slightly lower specific gravity. In addition, we plan to try filled nylons and polypropylenes with long glass fibers in hopes that even though they have a higher density that they may absorb more nitrogen and make the final product lighter.

The foregoing description of the specific embodiments will so fully reveal the general nature of the invention that others can, by applying current knowledge, readily modify and/or adapt for various applications such specific embodiments without departing from the generic concept. Therefore, such adaptations and modifications should and are intended to be comprehended within the meaning and range of equivalents of the disclosed embodiments. It is to be understood that the phraseology of terminology employed herein is for the purpose of description and not of limitation.

We claim:

1. A method for making a microcellular drumstick, the method comprising the steps of providing a mold with a cavity in the shape of a drumstick wherein the mold has cooling hardware for cooling the mold;

preparing a molten polymer, wherein the molten polymer comprises at least one plastic and at least one filler that are melted in a controlled manner in an extruder;

incorporating into the molten polymer a gas which is pressurized or is supercritical thereby creating a mixture of the polymer and the gas inside the extruder;

injecting a selected amount of the gas/polymer mixture into the mold at a selected rate of injection;

controlling the mold temperature and allowing the mixture to internally foam inside the mold so as to achieve a targeted density and size range of microcells in a solidified polymer; and removing a finished microcellular drumstick from the mold.

2. The method of claim 1, wherein the plastic is either polypropylene, polymethylpentene or a polyamide.

3. The method of claim 1, wherein the filler is fiber glass, glass fibers or impact modifiers.

4. The method of claim 1, wherein the filler comprises an agent that makes the drumstick a specific color or makes the drumstick glow in the dark.

5. The method of claim 1, wherein the gas is selected from nitrogen, carbon dioxide, or an inert gas.

6. The method of claim 1, wherein the volume percentage of gas in the mixture is in the range of 5% to 50%.

7. A drumstick made by the method of claim 1.

* * * * *